US012535306B2

(12) United States Patent
Padgett

(10) Patent No.: US 12,535,306 B2
(45) **Date of Patent: *Jan. 27, 2026**

(54) POLYMER CARTRIDGE WITH SNAPFIT METAL INSERT

(71) Applicant: PCP Tactical, LLC, Sebastian, FL (US)

(72) Inventor: Charles Padgett, Vero Beach, FL (US)

(73) Assignee: PCP Tactical, LLC, Sebastian, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/794,930

(22) Filed: Aug. 5, 2024

(65) Prior Publication Data

US 2025/0035413 A1 Jan. 30, 2025

Related U.S. Application Data

(63) Continuation of application No. 17/833,183, filed on Jun. 6, 2022, now Pat. No. 12,055,373, which is a (Continued)

(51) Int. Cl.
*F42B 5/307* (2006.01)
*F42B 5/02* (2006.01)
(Continued)

(52) U.S. Cl.
CPC ..... *F42B 5/307* (2013.01); *F42B 5/313* (2013.01); *F42C 19/083* (2013.01); *F42B 5/02* (2013.01)

(58) Field of Classification Search
CPC ..... F42B 5/02; F42B 5/26; F42B 5/30; F42B 5/307; F42B 5/313; F42C 19/08; F42C 19/083; F42C 19/0807; F42C 19/0823
(Continued)

(56) References Cited

U.S. PATENT DOCUMENTS 3,099,958 A 8/1963 Daubenspeck et al.
4,187,271 A 2/1980 Rolston et al.
(Continued)

FOREIGN PATENT DOCUMENTS

GB 672706 A 5/1952
WO 2013182557 A1 12/2013

OTHER PUBLICATIONS

International Search Report issued in corresponding International Patent Application No. PCT/US19/14244 dated Mar. 29, 2019.
(Continued)

*Primary Examiner* — James S Bergin
(74) *Attorney, Agent, or Firm* — Troutman Pepper Locke LLP

(57) ABSTRACT

A high strength polymer-based cartridge has a polymer case with a mouth, a neck, a shoulder below the neck, and a body below the shoulder and having a case thickness (Tc). The body has a flat portion comprising a pull thickness (Tp), and a dip, closer to the shoulder than the flat portion and comprising a dip thickness (Tb). The cartridge can also include an insert attached to the polymer case opposite the shoulder. The insert can have a flat section contacting the flat portion and comprising an insert wall thickness (Ti), and a bulge engaging the dip to maintain the insert on the polymer case. Tc, Tp, Tb, and Ti are related by Tp+Tb+Ti=Tc. These variables also have ranges where Tp is at least 0.010 inches in thickness, Tb is greater than or equal to Tp, and Tc is a function of a loaded projectile.

2 Claims, 3 Drawing Sheets

Related U.S. Application Data continuation of application No. 16/963,440, filed as application No. PCT/US2019/014244 on Jan. 18, 2019, now Pat. No. 11,353,298.

(60) Provisional application No. 62/619,493, filed on Jan. 19, 2018.

(51) Int. Cl.
*F42B 5/313* (2006.01)
*F42B 19/08* (2006.01)
*F42C 19/08* (2006.01)

(58) Field of Classification Search
USPC ..... 102/464, 466, 467, 469, 470
See application file for complete search history.

(56) References Cited

U.S. PATENT DOCUMENTS

| | | | | |
|---|---|---|---|---|
| 4,738,202 | A | 4/1988 | Hebert | |
| 5,151,555 | A | 9/1992 | Vatsvog | |
| 5,259,288 | A | 11/1993 | Vatsvog | |
| 6,752,084 | B1 | 6/2004 | Husseini et al. | |
| 6,845,716 | B2 | 1/2005 | Husseini et al. | |
| 7,610,858 | B2 | 11/2009 | Chung | |
| 8,240,252 | B2 | 8/2012 | Maljkovic et al. | |
| 8,813,650 | B2 * | 8/2014 | Maljkovic | F42B 5/313 102/466 |
| 9,182,204 | B2 | 11/2015 | Maljkovic et al. | |
| 9,188,412 | B2 | 11/2015 | Maljkovic et al. | |
| 9,335,137 | B2 * | 5/2016 | Maljkovic | F42B 5/025 |
| 9,395,165 | B2 | 7/2016 | Maljkovic et al. | |
| 11,199,384 | B2 | 12/2021 | Koh et al. | |
| 11,353,298 | B2 | 6/2022 | Padgett | |
| 11,448,491 | B2 | 9/2022 | Padgett | |
| 11,578,955 | B2 | 2/2023 | Sanner et al. | |
| 12,055,373 | B2 * | 8/2024 | Padgett | F42B 5/313 |
| 2005/0081704 | A1 | 4/2005 | Husseini | |
| 2014/0234785 | A1 | 8/2014 | Hatakeyama et al. | |
| 2014/0235784 | A1 | 8/2014 | Maljkovic et al. | |
| 2016/0025464 | A1 | 1/2016 | Maljkovic et al. | |
| 2016/0131463 | A1 | 5/2016 | Stauffer | |
| 2018/0292186 | A1 | 10/2018 | Padgett et al. | |
| 2021/0254951 | A1 | 8/2021 | Padgett et al. | |
| 2022/0011078 | A1 | 1/2022 | Padgett et al. | |
| 2023/0184523 | A1 | 6/2023 | Padgett et al. | |

OTHER PUBLICATIONS

Extended European Search Report dated Nov. 26, 2021, from corresponding European Application No. 19741787.6.

* cited by examiner

POLYMER CARTRIDGE WITH SNAPFIT METAL INSERT

CROSS REFERENCE TO RELATED APPLICATIONS

This is a continuation application of U.S. patent application Ser. No. 17/833,183 filed Jun. 6, 2022, which is a continuation application of U.S. patent application Ser. No. 16/963,440 filed Jul. 20, 2020, which is a U.S. National Phase Application under 35 U.S.C. § 371 of International Patent Application No. PCT/US2019/014244, filed Jan. 18, 2019, which claims priority of U.S. Provisional Patent Application No. 62/619,493, filed Jan. 19, 2018. The entire contents of which are hereby incorporated by reference.

FIELD OF INVENTION

The present subject matter relates to ammunition articles with plastic components such as cartridge casing bodies, and, more particularly, a base insert used with the plastic cartridges.

BACKGROUND

It is well known in the industry to manufacture bullets and corresponding cartridge cases from either brass or steel. Typically, industry design calls for materials that are strong enough to withstand extreme operating pressures and which can be formed into a cartridge case to hold the bullet, while simultaneously resist rupturing during the firing process.

Conventional ammunition typically includes four basic components, that is, the bullet, the cartridge case holding the bullet therein, a propellant used to push the bullet down the barrel at predetermined velocities, and a primer, which provides the spark needed to ignite the powder which sets the bullet in motion down the barrel.

The cartridge case is typically formed from brass and is configured to hold the bullet therein to create a predetermined resistance, which is known in the industry as bullet pull. The cartridge case is also designed to contain the propellant media as well as the primer. However, brass is heavy, expensive, and potentially hazardous. For example, the weight of .50 caliber ammunition is about 60 pounds per box (200 cartridges plus links).

The cartridge case, which is typically metallic, acts as a payload delivery vessel and can have several body shapes and head configurations, depending on the caliber of the ammunition. Despite the different body shapes and head configurations, all cartridge cases have a feature used to guide the cartridge case, with a bullet held therein, into the chamber of the gun or firearm.

The primary objective of the cartridge case is to hold the bullet, primer, and propellant therein until the gun is fired. Upon firing of the gun, the cartridge case seals the chamber to prevent the hot gases from escaping the chamber in a rearward direction and harming the shooter. The empty cartridge case is extracted manually or with the assistance of gas or recoil from the chamber once the gun is fired.

One of the difficulties with polymer ammunition is having enough strength to withstand the pressures of the gases generated during firing. In some instances, the polymer may have the requisite strength, but be too brittle at cold temperatures, and/or too soft at very hot temperatures. Additionally, the spent cartridge is extracted at its base, and that portion must withstand the extraction forces generated from everything from a bolt action rifle to a machine gun.

Since the base extraction point can be an area of failure, numerous concepts have developed to overcome the issues. Inventors like Daubenspeck, U.S. Pat. No. 3,099,958 have developed full metal inserts that are both overmolded (i.e. the polymer of the cartridge case is molded over the metal and undermolded (i.e. the polymer of the cartridge is molded inside the insert. This allows the insert to be added as part of the polymer molding process. Other references, illustrate inserts that are added to the cartridge after it is formed. In these instances, the metal insert is either friction fit or screwed on to the back of the cartridge case. See, U.S. Pat. No. 8,240,252.

While these solutions may function for isolated rounds or with certain extractors there is no way to determine what type of friction fit will function with all rounds and extractors. Hence a need exists for a polymer casing that can perform as well as or better than the brass alternative. A further improvement is the base inserts to the polymer casings that are capable of withstanding all of the stresses and pressures associated with the loading, firing and extraction of the casing.

SUMMARY

Thus, the invention includes a high strength polymer-based cartridge having a polymer case, with a first end having a mouth, a neck extending away from the mouth, a shoulder extending below the neck and away from the first end, and a body formed below the shoulder and having a case thickness (Tc), The body can have a flat portion comprising a pull thickness (Tp), and a dip, closer to the shoulder than the flat portion and comprising a dip thickness (Tb). The cartridge can also include an insert attached to the polymer case opposite the shoulder. In some examples the insert is metal or metal alloy. The insert can have a flat section contacting the flat portion and comprising an insert wall thickness (Ti), and a bulge engaging the dip to maintain the insert on the polymer case. Further, the cartridge has a projectile disposed in the mouth having a particular caliber.

In one example, the case thickness, the pull thickness, the dip thickness, and the insert wall thickness are related by Tp+Tb+Ti=Tc. These variables also have ranges where Tp equals approximately 15-33% of Tc, Tb is greater than or equal to Tp, and Tc is a function of the projectile and a ballistic performance for the projectile.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, and/or components have been described at a relatively high-level, without detail, in order to avoid unnecessarily obscuring aspects of the present teachings.

Figure 1:
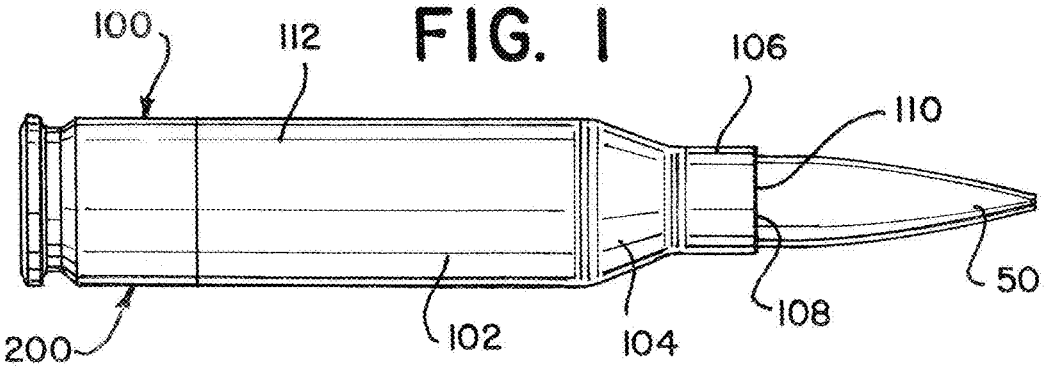
FIG. 1 is a side elevation sectional view of a bullet and cartridge in accordance with an example of the invention.

Referring now to FIG. 1, an example of a cartridge 100 for ammunition has a cartridge case 102 which transitions into a shoulder 104 that tapers into a neck 106 having a mouth 108 at a first end 110. The mouth 108 can be releasably connected to, in a conventional fashion, to a bullet or other weapon projectile 50. The cartridge case can be made from a plastic material, for example a suitable polymer. The rear end 112 of the cartridge case is connected to a base 200.

Figure 2A:
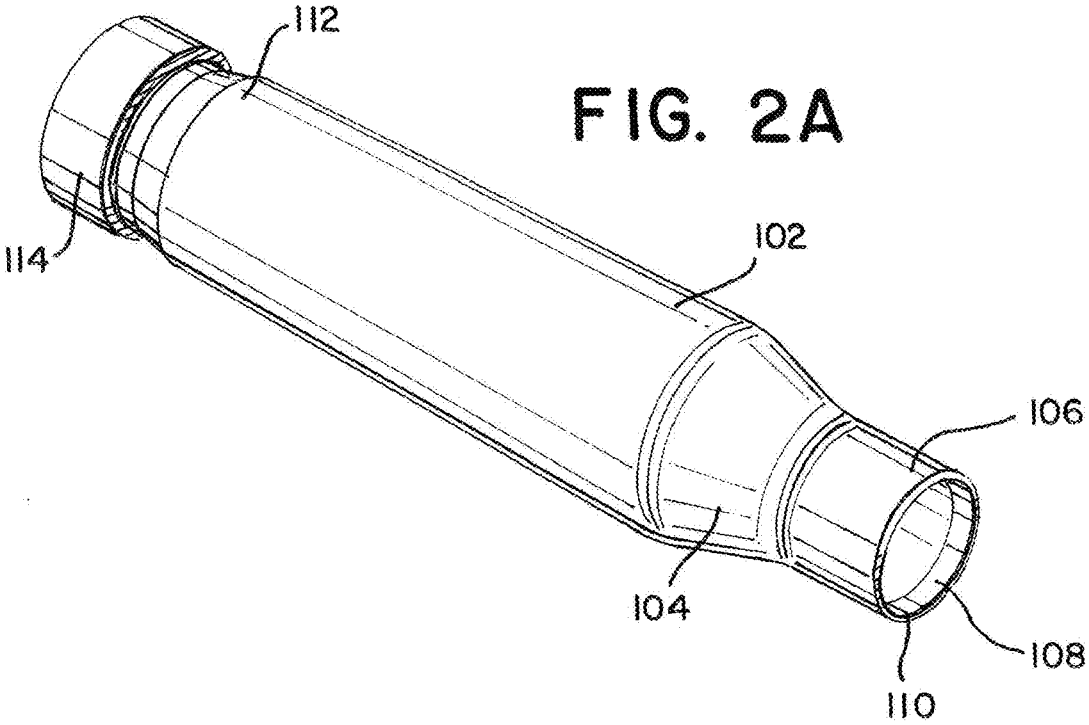
FIG. 2A is a perspective view of the cartridge body in accordance with an example of the invention.
Figure 2B:
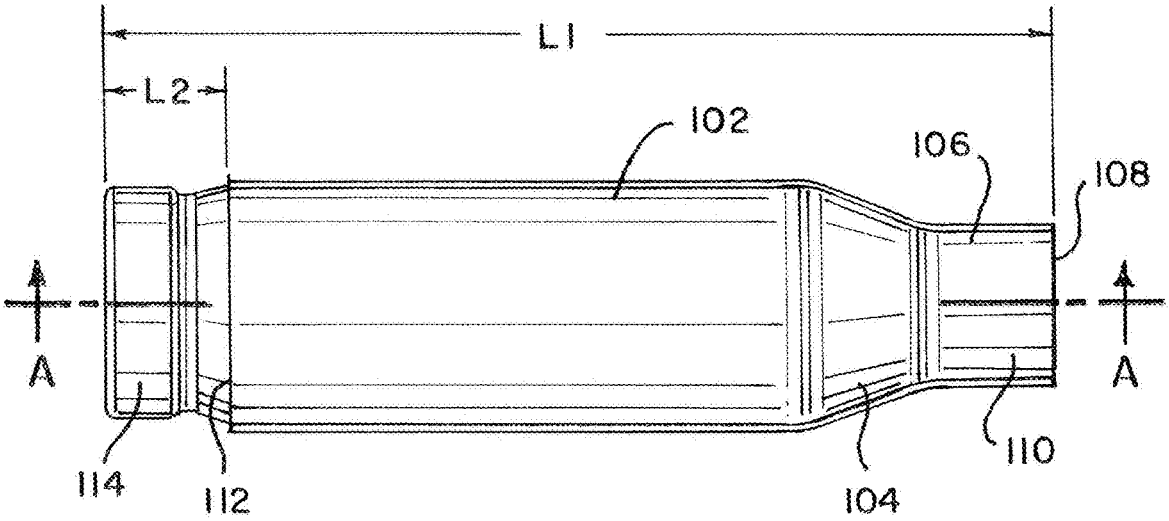
FIG. 2B is a side view of the cartridge body of FIG. 2A.
Figure 2C:
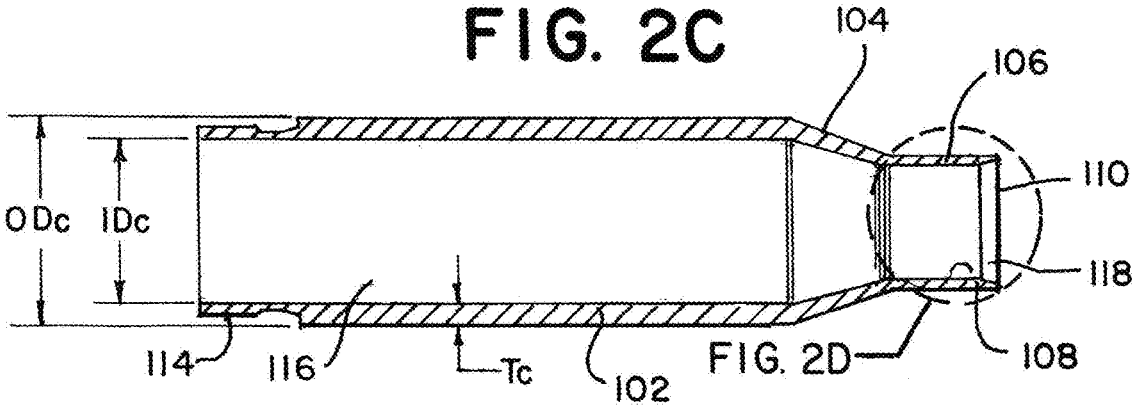
FIG. 2C is a cross-sectional view along line A-A of the cartridge body of FIG. 2B.

FIGS. 2A-2C illustrate the cartridge case 102 without the projectile 50 or base 200. FIGS. 2A-2C illustrate the base interface portion 114 positioned at the rear end 112 which provides the contact surface with the base insert 200. This is described in detail below. FIG. 2B illustrates that the case 102 from the front of the front end 110 to the rear of the rear end 112 has a length L1. The base interface portion 114 has a length L2.

FIG. 2C illustrates a cross-section of the case 102 along line A-A. Here, the majority of the case 102 forms a propellant chamber 116. The propellant is typically a solid chemical compound in powder form commonly referred to as smokeless powder. Propellants are selected such that when confined within the cartridge case 100, the propellant burns at a known and predictably rapid rate to produce the desired expanding gases. The expanding gases of the propellant provide the energy force that launches the bullet from the grasp of the cartridge case and propels the bullet down the barrel of the gun at a known and relatively high velocity. The volume of the propellant chamber 116 determines the amount of powder, which is a major factor in determining the velocity of the projectile 50 after the cartridge 100 is fired. The volume of the propellant chamber 116 can be adjusted by increasing a case wall thickness Tc or adding an insert (not illustrated). The type of powder and the weight of the projectile 50 are other factors in determining projectile velocity. The velocity can then be set to move the projectile at subsonic or supersonic speeds.

Figure 2D:
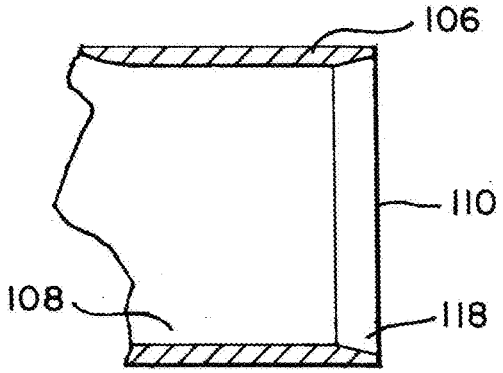
FIG. 2D is a magnified cross-sectional view of an example of the mouth of the cartridge body of the invention.

FIG. 2D is a magnified cross-section of the neck 106 and mouth 108. In this example, at the mouth 108 is a relief 118. The relief 118 is a recess cut into the neck 106 proximate the front of the front end 110. The relief 118 can be used to facilitate the use of an adhesive to seat the bullet 50. Even if the bullet 50 seats tightly in the neck 106, certain types of ammunition needs to be made waterproof. Waterproofing a round can include using a waterproof adhesive between the bullet 50 and the mouth 108/neck 106. The relief 118 allows a gap between the bullet 50 and the neck 106 for the adhesive to pool and set to make a tight, waterproof seal. The adhesive also increases the amount of tension necessary to remove the bullet 50 from the mouth 108 of the casing. The increase in required pull force helps keep the bullet from dislodging prior to being fired.

The relief 118 can be formed as a thinner wall section of the neck 106. It can be tapered or straight walled. If the relief 118 is tapered, the inner diameter will increase in degrees as it moves from the mouth 108 down the neck 106. Alternately, the relief 118 can be stair stepped, scalloped, or straight walled and ending in a shelf 120. Additionally, an example of the adhesive can be a flash cure adhesive that cures under ultraviolet (UV) light. Further, once cured, the adhesive can fluoresce under UV in the visual spectrum to allow for visual inspection. Additional flash cure adhesives can fluoresce outside the visual spectrum but be detected with imaging equipment tuned to that wavelength or wavelength band.

Figure 3A:
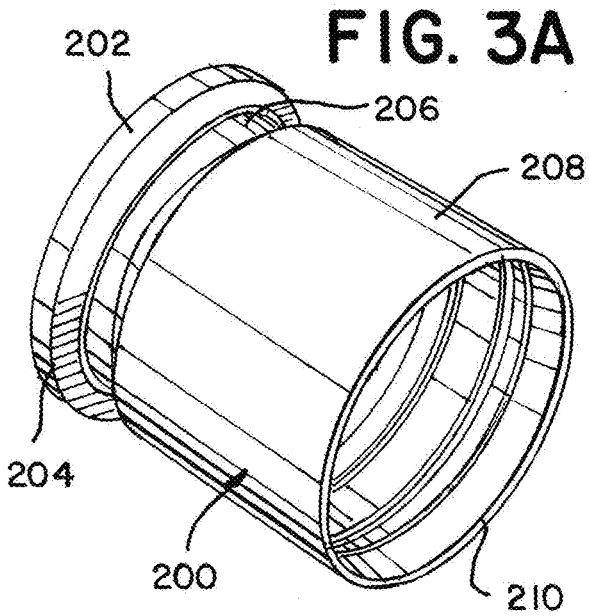
FIG. 3A is a perspective view of the body insert in accordance with an example of the invention.
Figure 3B:
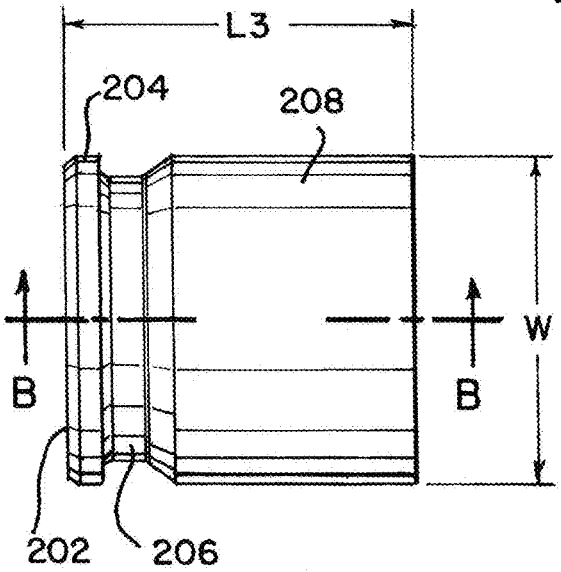
FIG. 3B is a side view of the body insert of FIG. 3A.
Figure 3C:
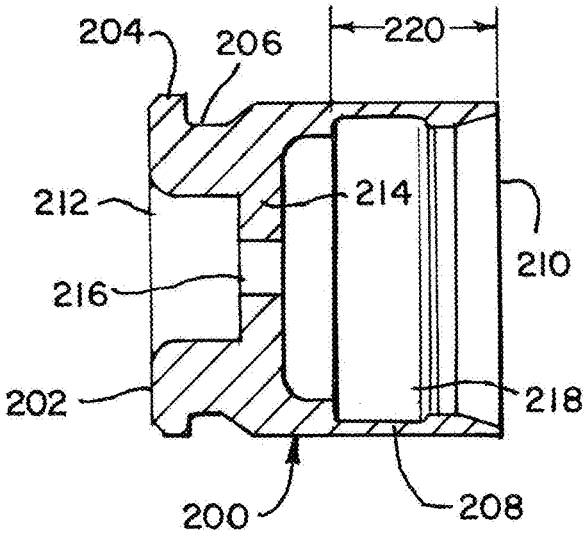
FIG. 3C is a cross-sectional view along line B-B of the cartridge body of FIG. 3B.

FIGS. 3A-3C illustrate the base/insert 200 separate from the cartridge case 102 and the projectile 50. The base 200 has a rear end 202 with an enlarged extraction lip 204 and groove 206 just in front to allow extraction of the base 200 and cartridge 100 in a conventional fashion. An annular cylindrical wall 208 extends forward from the rear end 202 to the front end 210. FIG. 3C illustrates a primer cavity 212 located at the rear end 202 and extends to a radially inwardly extending ledge 214 axially positioned intermediate the rear end 202 and front end 210. A reduced diameter passage 216, also known as a flash hole, passes through the ledge 214. The cylindrical wall 208 defines an open ended main cavity 218 from the ledge 214 to open front end 210. The primer cavity 212 and flash hole 216 are dimensioned to provide enough structural steel at annular wall 208 and ledge 214 to withstand any explosive pressures outside of the gun barrel.

FIG. 3B illustrates the base length L3 from rear to front ends 202, 210. As will be described, only a portion of the base length L3 of the insert 200 engages with the base interface portion 114 along its length L2. The case interface portion 220 is shaped to interface with the case's 102 base interface portion 114. The case 102 and the base 200 are "snapped" or friction fit together. This occurs after both pieces are formed. The design can be as such to have the polymer base interface portion 114 "inside" the insert 200, i.e. the portion defined by length L2, and at that only the insert wall 208 is exposed. The insert 200, in this example, is not overmolded. Thus, the width W, or outer diameter, of the insert 200 approximately matches an outer diameter of the case 102 at that point (i.e., ODc).

Figure 4A:
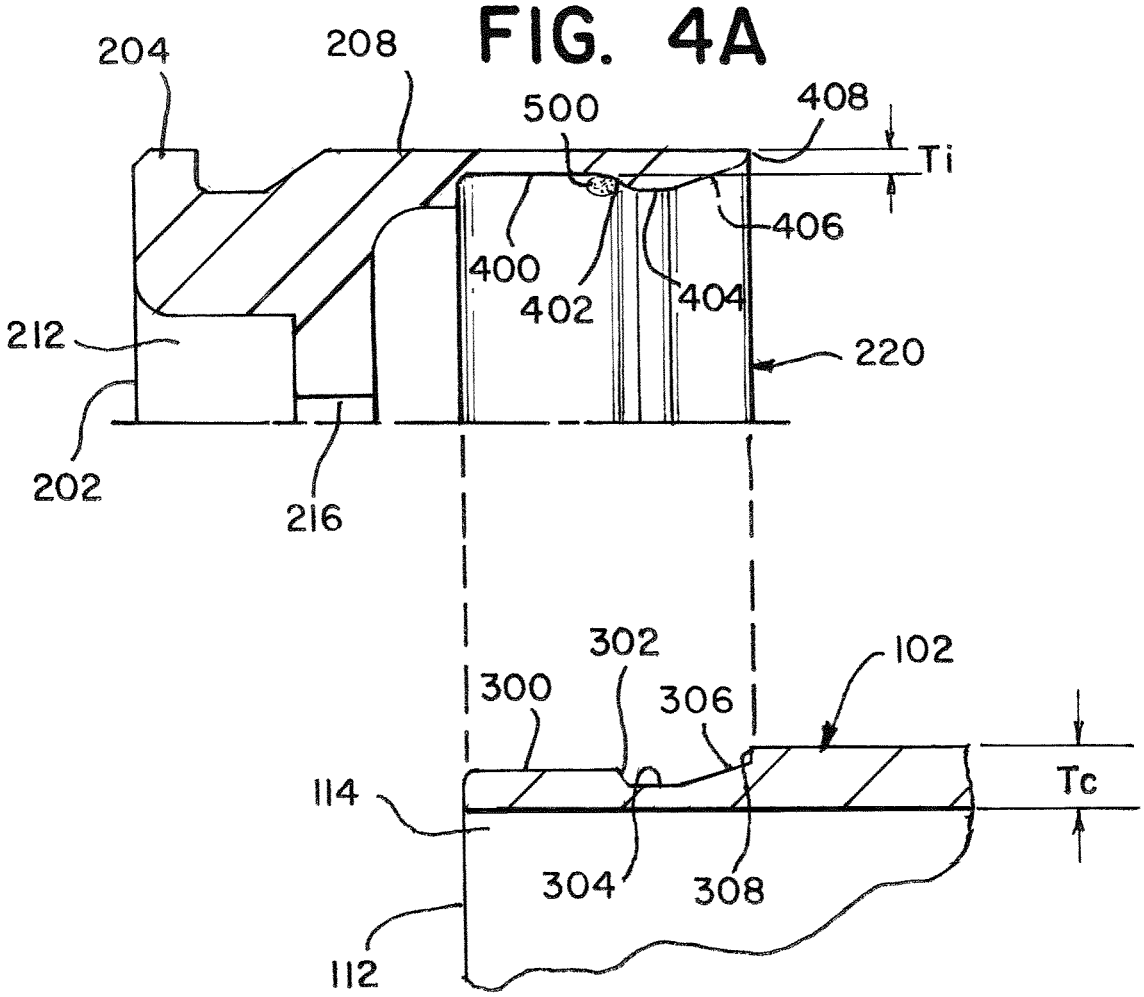
FIG. 4A is a magnified, exploded, cross-section view of the base interface portion and the case interface portion.

FIG. 4A illustrates an exploded magnified view of the case interface portion 220 and the base interface portion 114. Turning first to an example of the base interface portion 114, there is the flat portion 300 followed by a first slope 302. The base interface portion 114 then straightens out to dip 304 followed by a second slope 306, which can end in edge 308 before meeting the main wall of the case 102. As noted above, the case wall thickness Tc is the thickness of the wall and the outside of the wall forms the outer diameter of the entire cartridge 100. Thus, the wall thicknesses of the base interface portion 114 must be less than the case wall thickness Tc so when the base 200 is fit on, its wall 208 approximately matches the diameter of the cartridge 100.

The features on the case interface portion 220 generally mirror those on the base interface portion 114 so the two can connect. The insert 200 can have a flat section 400 leading to a first incline 402. At the end of the first incline 402 is a bulge 404 which is generally flat until the second incline 406 which then can end in a vertical tip 408. These features 400, 402, 404, 406, 408 in metal, particularly the first incline 402 and the bulge 404 can be used to keep the base 200 on the case 102. The flat section 400 can have a thickness Ti.

However, the reduced wall thicknesses of the base interface portion 114 can be points of failure since the polymer is the thinnest where most stresses occur during ejection of the round 100 after firing. Metal inserts, whether molded or friction fit, can fail in at least two ways. The two common ways are "pull-off" and "break-off." In a pull-off failure, the metal insert is pulled away from the polymer cartridge during extraction, thus the base is ejected, but the reminder of the cartridge remains in the chamber. The polymer is not damaged, just the bond between the metal and polymer failed and the base "slipped" off. In break-off failure, the polymer is broken, typically at the thinnest point, and the insert, along with some polymer, are ejected. Pull-off failure can occur in any type cartridge, while break-off failure is less common in reduced capacity polymer cartridges. Reduced capacity, e.g. subsonic polymer rounds, are already thickening the walls inside the cartridge, and can alleviate this issue. Break-off primarily occurs in supersonic or standard rounds where maximum capacity is an important factor and the wall thickness Tc is at its minimum.

Figure 4B:
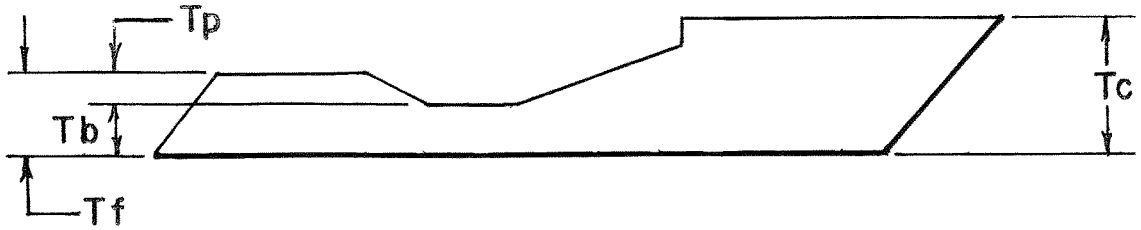
FIG. 4B is a magnified cross-sectional view of the base interface portion.

To overcome these problems, the inventors have identified certain critical thicknesses that overcome pull-off and break-off failures. FIG. 4B illustrates the specific critical thicknesses in this example. The case 102 has a thickness Tc, which is typically the wall thickness of the propellant chamber 116 and the majority of the round 100 below the shoulder 104. The thinnest section of the base interface portion 114 is thickness Tb, this is the thickness of the case wall at the dip 304. It is this thickness that dictates whether or not the insert 200 experiences break-off failure. The next critical thickness is Tp, which is the difference between a wall thickness Tf of the flat portion 300 and the dip thickness Tb. Thickness Tp can also be described as the depth of the dip 304 itself. This pull thickness Tp is a factor of whether or not the insert 200 can be pulled off during extraction. The larger pull thickness Tp, the deeper the dip 304 and thus more of the bulge 404 can act to withstand the extraction force.

There is a relationship between the dip thickness Tb and the pull thickness Tp. Thickening the dip thickness Tb to reduce the likelihood of break-off failure reduces the pull thickness Tp by making the dip 304 shallower, decreasing the bulge 404 penetration, and increasing the likelihood of pull-off failure. The converse is also true, increasing the pull thickness Tp thins the dip thickness Tb and makes break-off failure more common.

The inventor determined certain ratios of thicknesses to prevent both types of failure. The first relationship is that of the thickness of the cartridge 100 at the insert section:

$$Tb+Tp+Ti=Tc$$

Or, that the cumulative thickness of the dip thickness Tb, pull thickness Tp, and insert thickness Ti must equal the thickness of the case Tc so that there is a smooth outer cartridge wall for loading and extraction from the weapon's chamber. The proportions of the thicknesses Tb, Tp and Ti do not have to be equal, and the inventor determined optimal ranges for each in relation to Tc. In one example, the pull thickness Tp is between 15-33% Tc, the dip thickness Tb can be greater than or equal to the pull thickness Tp or, in a different example can be at least 20% of Tc. The insert thickness Ti can be the remainder of the sum of the pull and dip thicknesses Tp, Tb.

Additionally, one example can have the pull thickness Tp at approximately 0.010 inches or greater. However, while more pull thickness Tp is helpful, there is a point of diminishing returns based on maximizing the size of the propellant chamber 116. Other examples range the pull thickness Tp between approximately 0.010-0.020 inches. Table 1 below sets out some experimental results:

TABLE 1

| | .308 Winchester | | .50 Cal | | 6.5 mm SOCOM | |
|---|---|---|---|---|---|---|
| Thickness | Inch | % Tc | Inch | % Tc | Inch | % Tc |
| Tp | 0.010 | 21.739 | 0.010 | 16.667 | 0.010 | 22.222 |
| Tb | 0.016 | 34.783 | 0.035 | 58.333 | 0.010 | 22.222 |
| Ti | 0.020 | 43.478 | 0.015 | 25.000 | 0.025 | 55.556 |
| Tc | 0.046 | | 0.060 | | 0.045 | |

There can be limits to how thick and thin certain elements are. The cartridge and the firearm chambered for that cartridge have to function together. For consistency throughout the industry and the world, dimensions of the cartridge case and the firearm chambers for a particular caliber are very tightly dimensionally controlled. A variety of organizations exist that provide standards in order to help assure smooth functioning of all ammunition designed for a common weapon. Non-limiting examples of these organizations include the Sporting Arms and Ammunition Manufacturers' Institute (SAAMI) in USA, the Commission Internationale Permanente pour l'epreuve des armes a feu portatives (CIP) in Europe, as well as various militaries around the globe as transnational organizations such as the North Atlantic Treaty Organization (NATO).

SAAMI is the preeminent North American organization maintaining and publishing standards for dimensions of ammunition and firearms. Typically, SAAMI and other regulating agencies will publish two drawings, one that shows the minimum (MIN) dimensions for the chamber (i.e. dimensions that the chamber cannot be smaller than), and one that shows the maximum (MAX) ammunition external dimensions (i.e. dimensions that the ammunition cannot exceed). The MIN chamber dimension is always larger than the MAX ammunition dimension, assuring that the ammunition round will fit inside the weapon chamber. All published SAAMI, NATO, US Department of Defense (US DOD) and CIP drawings are incorporated here by reference.

It is important to note that SAAMI compliance and standardization is voluntary. SAAMI does not regulate all possible calibers, especially those for which the primary use is military (for example, .50 BMG (12.7 mm) calibers are maintained by the US DOD), or the calibers which have not yet been submitted (wildcat rounds, obscure calibers, etc.)

Turning back to FIG. 2C, the propellant chamber 116 has an average outer wall diameter ODc and an average inner wall diameter IDc. The outer and inner diameters ODc, IDc dictate the cartridge wall thickness Tc and the inner wall diameter IDc can affect the volume of the propellant chamber. Particular cartridges for particular caliber projectiles have standard outside dimensions so the cartridge outer diameter ODc is fixed. In a military specified cartridge and caliber, the specifications typically call for maximum projectile performance, one main factor of which is projectile speed. Specifications also dictate a chamber pressure, so as to not over pressure and destroy the weapon chamber. For example, for a 7.62 caliber round, the specification calls for an average projectile speed of 2750±30 fps at an average chamber pressure of 57,000 psi. Fixing the maximum cartridge outer diameter ODc and the ballistic specifications, then dictate the volume of the propellant chamber 116 to allow enough powder to meet those requirements. This leads to, at best, very small reductions in the inner diameter IDc to balance all of these factors.

The present invention contemplates all of the factors of standard outside dimensions, maximizing powder chamber dimensions to maximize projectile performance, pull-off failure, break-off failure and manufacturing tolerance for the case and insert. Thus, for any cartridge having matching ballistic requirements, the outer case diameter ODc is set, the inner case diameter IDc can be approximated by the amount of powder for given performance, and the present invention can then be used to size the base interface portion 114 and the case interface portion 220.

Using the above concepts, the base 200 and the case 102 can be friction fit together and withstand the forces necessary during loading, firing, and extraction of the cartridge 100, no added adhesive at the rear 112 of the case 102 required. This friction fit is also typically water resistant. However, additional water proofing may be required for extreme uses. In one example of the present invention, a sealant 500 is applied only to the first incline 402 before the base 200 and case 102 are assembled. The sealant 500 does not coat the second slope/incline 206, 306 or the dip/bulge 304, 404. In one example, as the base 200 is forced over the base interface portion 114, the bulge 404 keeps the sealant 500 away from the case 102 until it enters the dip 304. Now, the sealant 500 is smeared under pressure along the flat portion/section 300, 400. This keeps the metal/polymer interface for the friction fit. In another example, as the bulge 404 slides over the flat portion 300 and flat section 400, at least the trailing edge of the sealant 500 is smeared across the flat portion 300 so that when the bulge 404 finally engages the dip 304, the sealant 500 is generally smeared across and interfaces between the flat portion 300 and flat section 400.

Note that in the examples above, the present invention can be used with single polymer body cases or multiple part polymer cases. The cases can be molded whole or assembled in multiple parts. The polymers herein can be any polymer or polymer metal/glass blend suitable to withstand the forces of loading, firing and extracting over a wide temperature range as defined by any commercial or military specification. The metal or metal alloys can be, again, any material that can withstand the necessary forces. The base can be formed by any method, including casting, hydroforming, and turning. The above inventive concepts can be used for any case for any caliber, either presently known or invented in the future.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

I claim:

1. A high strength polymer-based cartridge, comprising:

a polymer case, comprising:

a first end having a mouth;

a neck extending away from the mouth;

a shoulder extending below the neck and away from the first end;

a body formed below the shoulder and having a case thickness (Tc), comprising:

a flat portion comprising a pull thickness (Tp); and a dip, closer to the shoulder than the flat portion and comprising a dip thickness (Tb);

an insert directly attached to the polymer case at a second end opposite the first end, comprising:

a flat section contacting the flat portion and comprising an insert wall thickness (Ti); and a bulge engaging the dip to maintain the insert on the polymer case; and a projectile disposed in the mouth having a particular caliber;

wherein the case thickness, the pull thickness, the dip thickness, and the insert wall thickness are related as follows:

$$Tp+Tb+Ti=Tc;$$

wherein Tp is at least 0.010 inches in thickness;

wherein Tb is greater than or equal to Tp; and wherein Tc is a function of the projectile and a ballistic performance for the projectile.

2. The high strength polymer-based cartridge of claim 1, wherein Tp is between approximately 0.010 to approximately 0.020 inches.

* * * * *